US005537919A

United States Patent [19]

Bielfeldt et al.

[11] Patent Number: 5,537,919

[45] Date of Patent: Jul. 23, 1996

[54] MEASURING AND CONTROL SYSTEM FOR A CONTINUOUSLY OPERATING PRESS

[75] Inventors: Friedrich B. Bielfeldt, Paehl; Matthias Graf, Zaisenhausen, both of Germany

[73] Assignee: Maschinenfabrik J. Dieffenbacher GmbH & Co., Eppingen, Germany

[21] Appl. No.: 363,864

[22] Filed: Dec. 27, 1994

[30] Foreign Application Priority Data

Dec. 24, 1993 [DE] Germany ..... 43 44 400.8

[51] Int. Cl.[6] ..... B30B 5/06

[52] U.S. Cl. ..... 100/48; 100/93 RP; 100/99; 100/154; 156/378; 156/583.5; 425/171; 425/371

[58] Field of Search ..... 100/43, 48, 93 P, 100/93 RP, 99, 151, 154; 156/378, 583.5; 425/171, 371

[56] References Cited

U.S. PATENT DOCUMENTS

| | | | |
|---|---|---|---|
| 2,071,999 | 2/1937 | Dike | 100/154 |
| 2,191,282 | 2/1940 | Lewis | 100/99 |
| 2,821,907 | 2/1958 | Stone | 100/99 |
| 3,881,852 | 5/1975 | Ahrweiler | 425/149 |
| 4,408,520 | 10/1983 | Wons et al. | 100/93 P |
| 4,468,188 | 8/1984 | Gerhardt | 425/371 |
| 4,645,632 | 2/1987 | Böttger et al. | 100/154 |
| 5,112,431 | 5/1992 | Gerhardt et al. | 156/583.5 |
| 5,182,986 | 2/1993 | Bielfeldt | 100/151 |
| 5,193,451 | 3/1993 | Sitzler et al. | 100/154 |
| 5,253,571 | 10/1993 | Bielfeldt et al. | 100/41 |
| 5,323,696 | 6/1994 | Bielfeldt et al. | 100/154 |
| 5,333,541 | 8/1994 | Bielfeldt et al. | 100/41 |

FOREIGN PATENT DOCUMENTS

| | | | |
|---|---|---|---|
| 2536476 | 2/1977 | Germany . | |
| 2545366 | 4/1977 | Germany . | |
| 3101616 | 8/1982 | Germany . | |
| 4123517 | 9/1992 | Germany | 100/99 |
| 4208261C1 | 3/1993 | Germany . | |
| 3914105C2 | 8/1993 | Germany . | |
| 1611751 | 12/1990 | U.S.S.R. | 100/99 |

*Primary Examiner*—Stephen F. Gerrity
*Attorney, Agent, or Firm*—Foley & Lardner

[57] ABSTRACT

A continuously operating press for the production of particle boards, fiber boards and similar wood boards and plastic boards, wherein a spherical geometrical deformation of the press/heating platen in the longitudinal and transverse directions with the hydraulic actuators in positive or non-positive engagement with the press/heating platen is set during start-up or production by means of different actuating forces in the longitudinal and transverse directions, the setting process being independent of the reaction forces of pressing stock, wherein, to allow a convex bending deformation to be set at the maximum pressing force, the central actuators in each row of actuators are dimensioned to give 105% to about 150% of the maximum pressing force in relation to the outer actuators, and wherein each row of actuators has a position sensor system comprising a feeler rod, a reference gauge bar, a lever mechanism and a measured-value transmitter with a position sensor for the press-nip actual value in the center of the press/heating platen arranged between the web plates, underneath the actuators and outside the area in which the heat might exert a critical influence.

19 Claims, 5 Drawing Sheets

MEASURING AND CONTROL SYSTEM FOR A CONTINUOUSLY OPERATING PRESS

BACKGROUND OF THE INVENTION

The invention relates to a continuously operating press for the production of particle boards, fiber boards or similar wood boards and plastic.

Designs for such continuously operating presses have been disclosed by German Offenlegungsschrift/Patent 2,242,399, 2,536,476, 2,545,366, 3,133,817, 3,914,105.

SUMMARY OF THE INVENTION

To control the procedure, all continuously operating presses must precisely reproduce the process sequence, as is known from the known intermittent-operation press technology for the production of particle boards, MDF boards (Medium Density Fiber) or OSB boards (Oriented Strand Boards). For this purpose, it is necessary that all continuously operating presses should be capable of deforming at least one press/heating platen, either the upper or the lower one, spherically in the longitudinal and transverse directions in such a way that relatively large distances or nip clearances between the upper and the lower heated press platen can be set longitudinally in accordance with the different thicknesses of the boards to be produced, their moisture content and the resulting steel-belt speeds or, in other words, production rates, to give the necessary uniform steam distribution or degasification along the pressing zone. The same applies to a transverse deformation of the press/heating platen, this being essentially a convex action on the pressing stock, this having a favorable effect for example on the transverse tensile strength and, in association with this, also on the consumption of adhesive.

This object is achieved to greater or lesser degrees by all existing continuously operating presses, that is to say with a greater or lesser time requirement for a change in the process parameters for this.

In the case of the presses disclosed in German Patent 3,133,817 and 3,914,105, the spacings between the frames are chosen in such a way that the heating platens in conjunction with the slab are relatively thick. In the case of the press in accordance with German Patent 3,133,817, a counter heating facility is integrated into the slabs and, in accordance with German Patent 3,914,109, into the heating platens. By means of these counter heating facilities, the heating platens can be deformed concavely, in a plane-parallel manner or convexly. When there is a change in production, from a thick board (38 mm) to a thin board (8 mm) for example, the convex transverse deformation and the temperature profile must be changed. Due to the large masses to be heated of the press/heating platen and the slab with its counter heating facility, the system operates relatively slowly. As a result, changing the convex deformation takes a relatively long time and a partially different setting, as between each row of actuators, is not possible. In order to accelerate the transverse deformation processes (convex deformation) somewhat, the forces of the outer cylinders are changed or lowered with respect to the pressing cylinders arranged in the center. Due to the thickness of the heating and slab system, on-line adjustment, i.e. in the course of a change effected within a few seconds without interrupting production, by means of this change in the force in the cylinders is possible to only a limited extent, up to about 40%. Extreme changeovers from thick- to thin-board production are therefore only accomplished, if at all, by interrupting maintenance shifts—which can last for several hours—because the thermal changes require this time.

In the case of the presses from German Offenlegungsschrift 2,242,399, German Offenlegungsschrift 2,545,366 and German Offenlegungsschrift 2,545,476, each frame is assigned a multiplicity of pressing cylinders, allowing any desired spherical deformation of the press/heating platen to be carried out in the longitudinal and transverse directions. To this extent, such a press meets the requirement for an on-line adjustment without interrupting production. One disadvantage of this design of press that may be pointed out is that in order to be able to set the force profile in accordance with German Offenlegungsschrift 2,545,366, the pressure in the hydraulic pressure elements is lowered. This is achieved by means of the variability of the effective areas in the individual pressure elements, i.e. deactivation of partial areas (e.g. ⅓ of the piston area) along rows of actuators installed one behind the other does lead, in combination with a minimization of the external actuating forces, to a convex deformation transversely to the pressing zone. However, when the maximum pressing-force profile along the pressing zone is used, this leads locally to the minimization of the force profile in the longitudinal direction. With the control system for this servo-hydraulic system, it is either impossible to detect local bending deformation in the longitudinal and transverse directions by means of position sensors or, it is possible, then only from outside. The bending deformation is established only with the action of the reaction force of the pressing stock between the upper and lower press/heating platens. However, if it is necessary to establish a convex force profile transversely to the pressing zone at the maximum pressing force, matching the maximum possible pressing-force profile along the pressing zone, then it is no longer possible for the maximum pressing force to be maintained at least at the edges.

The setting of the press nip, that is of the desired value of thickness between the upper and lower press/heating platens, is performed in German Patent 2,242,399, for example, by means of a servo hydraulic nip control system, the desired thickness value being set by means of a spindle adjustment mechanism. Adjustment to the pressure in the center, i.e. transversely to the pressing zone, is performed, according to the details given in German Patent 2,536,476 for example, by changes in the pressure or deactivation of effective areas of the individual cylinder/pressure elements. The actual geometric change as regards a concave, planar or convex position cannot be detected or represented by means of this technology either. The setting process becomes more complicated if, for example, the intention is to set a spherical geometry. In the example, this means that if a convex deformation has already been set and a local longitudinal deformation in this region is to be set in addition, in order, for example, to effect degasification, there is a change in the situation as regards the geometrical position profile in the longitudinal direction. Only by means of time-consuming experimental measures is it possible, with this technology to set the optimum process parameter for a longitudinal and transverse deformation. It must also be regarded as a disadvantage that the outlay in terms of constructing the machinery is considerable since the design, which uses a relatively thin press/heating platen, requires a very narrow spacing between the frames, which means a large number of frames and hence also a large number of hydraulic actuating cylinders—i.e. almost a carpet of bottom pistons. This design of continuously operating press involves relatively high production costs.

The metrological detection of a geometric change transversely to the pressing zone has been part of the prior art for several decades. To measure the deflection of the press/heating platens, their surfaces are assigned touch probes or position sensors which measure the value as a function of the respective degree of deformation and pass preferably electrical pulses to a central control unit. In the control unit, which may also be a personal computer (PC) or processor, these pulses are compared as an actual value with the stored desired value and an error pulse is then calculated from a defined program and fed by way of valves to the relevant actuators, thus giving rise to different pressurization levels in the cylinders of the actuators. By means of these metrological means, it is also possible to display the transverse deformations entailed in this technology on screen (monitor). This means that the technologically required state can be set visually and the actuators acted upon on-line.

German Patent 3,101,616 discloses a beam-deformation measuring system for single-opening platen presses in which the measuring system comprises a measuring section consisting of strip or wire together with a position pick-up, a plurality of measuring sections being laid along or across the beam to be measured and being held outside the pressing zone. Because the design is a top-piston design, the sensing of the measured values for the deformation of the beam takes place in the critical zone of heat influence and thus operates in a manner prone to error and very prone to faults.

German Patent 4,208,261 has furthermore disclosed a method in which a deformation of the press beams due to the pressing force is measured, and according to this method at least one of the press beams is provided with or connected to a system of communicating tubes which are filled with a measuring fluid which, under the laws governing hydrostatics forms horizontal measurement surfaces in essentially vertical tube branches, the measured values being taken from these measurement surfaces and the press cylinder-piston arrangements being controlled and/or regulated accordingly. Such a measuring method is very involved and expensive. In addition, this method has the disadvantage—a disadvantage which may also be ascribed to the measuring system disclosed in German Patent 3,101,616, that the measured values are taken on a very small scale and that very high-resolution sensors must therefore be used without providing any guarantee, for all that, that unsatisfactory measurement results will not occur.

Another requirement made of modern systems, is for just-in-time production, i.e. flexible manufacture according to orders. This means that a continuously operating press must be capable of carrying out a change in production without interrupting operation. As stated above, the continuously operating presses known on the market at present can only do this to a limited extent or, in some cases, not at all.

The continuously operating presses constructed by the applicant hitherto operate on the principle of a lateral-arrangement top-piston press for the longitudinal influencing of the upper heating platen so as to deform the press along the pressing zone and with the additional arrangement of multi-pot/hydraulic short-stroke cylinders which are installed centrally underneath the lower heating platen for the purpose of transverse deformation. The principle of the press frame of this continuously operating press is known from Patent Application German Offenlegungsschrift 4,017,791. This embodiment of a continuously operating press is capable of setting the respective spherical deformation of the press/heating platen in the longitudinal and transverse directions in an on-line process in which a change in production is carried out without interrupting operation. However, the outlay in terms of constructing the machinery and the resulting production costs for this kind of continuously operating press is considerable, particularly due to the design of the press ram system with the associated arrangements of the laterally attached top pistons.

The object on which the invention is based is to improve the actuator system and the measuring and control system, acting on the actuators, on a continuously operating press of the generic type in such a way that it is possible to achieve a rapid change in the production parameters even during process optimization during start-up and production and during changeover to different board thicknesses and/or bulk densities, the maximum useful power in the maximum pressing-pressure profile range of the press and a product quality which can always be set reproducibly (on-line) and in an optimum manner and, at the same time, to give a concave, convex or spherical change in the geometry of the pressing zone along and across (the working surface) of the press/heating platen, with accurate transmission of the measured values by the measuring system, without negative effects from the heat and with a control and regulation strategy which operates in a transparent manner.

This object is achieved by the features and measures given according to the present invention.

The advantages of the invention are to be regarded, in particular, as the fact that with the control system provided it is possible to perform accurate setting of a convex, concave or spherical bending deformation of the press/heating platens in a few seconds, irrespective of the reaction force of the pressing stock and while maintaining the maximum pressing-force profile and the physical quality values for the pressing stock and that this can always be carried out reproducibly on-line even during the changeover to different board thicknesses and/or bulk densities during start-up and production. With the position-measuring system according to the invention, it is moreover possible, by the use of the hydraulic actuators in conjunction with the position-measuring system assigned to these actuators, to change the process parameters in a technologically optimum manner in real time along the entire pressing zone in the case of a complex process control operation, e.g. a change in the moisture content or the bulk-density profile in view of the respective board thicknesses and required transverse tensile strength.

Also advantageous is the fact that not only is it possible, by means of the sensing of the correct geometrical change with the position-measuring system according to the invention, to represent the spherical change in the pressing zone in the longitudinal and transverse directions accurately on-screen, but, in accordance with the technological requirements, these position-measurement values are input into the computer system as an actual value and compared with the desired value, after which the actuators are acted upon in a correcting manner by means of a new control pulse and it is thus possible to carry out process control in real time.

Another contributory factor in ensuring fault-free determination of the measured values for the press-nip clearances or the existing deformation of the press/heating platen in the center is that the position-measuring system is arranged outside the press and, by virtue of the 122 to 124 leverage, the measured values are transmitted to the outside out of the area subject to critical temperature effects, the leverage moreover providing optimum increased metrological resolution of the actual value.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENTS

Figure 1:
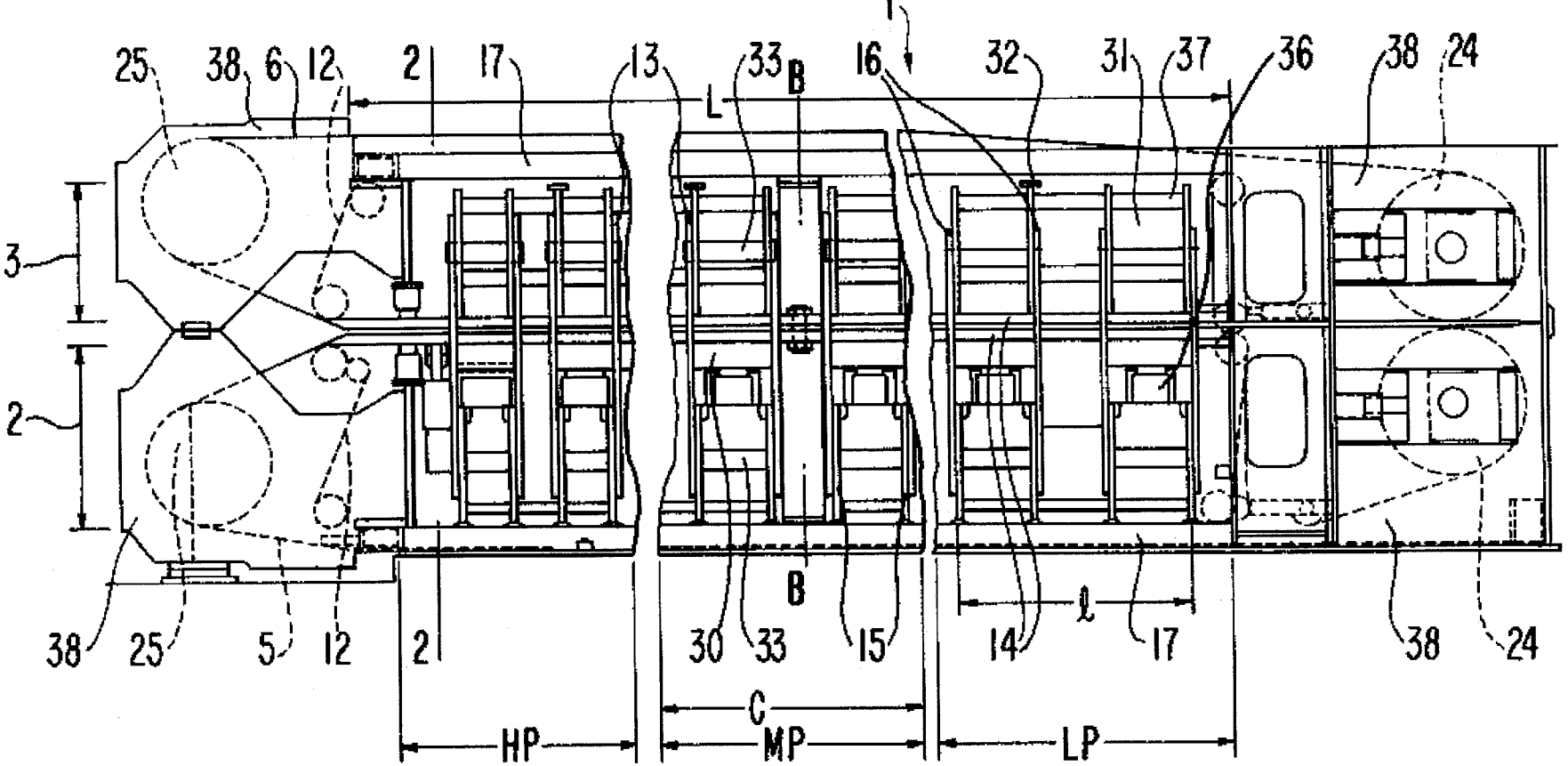
FIG. 1 shows the continuously operating press according to the invention in side view.
Figure 2:
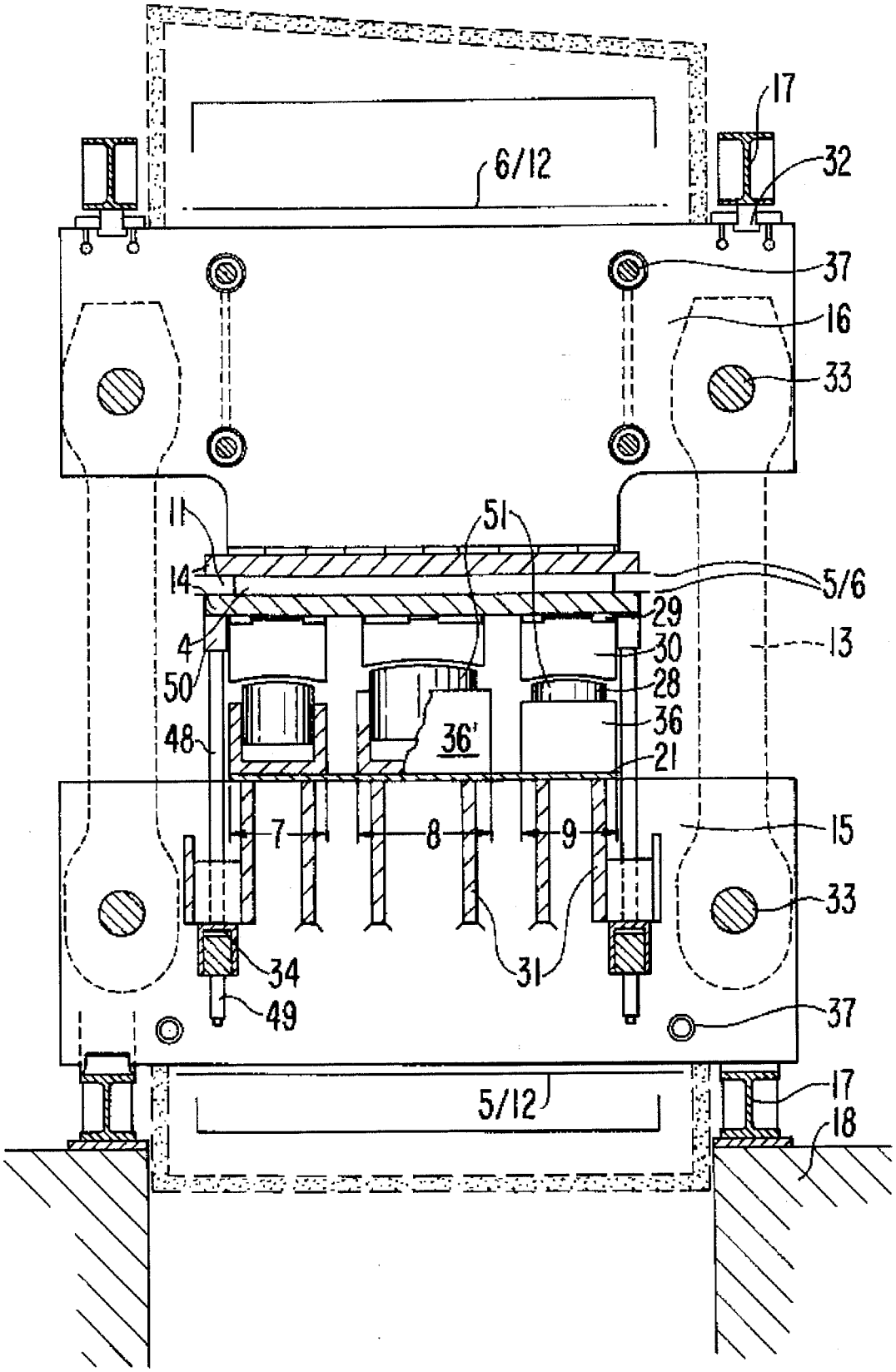
FIG. 2 shows the continuously operating press in accordance with FIG. 1 in front view and in a section 2—2.
Figure 3:
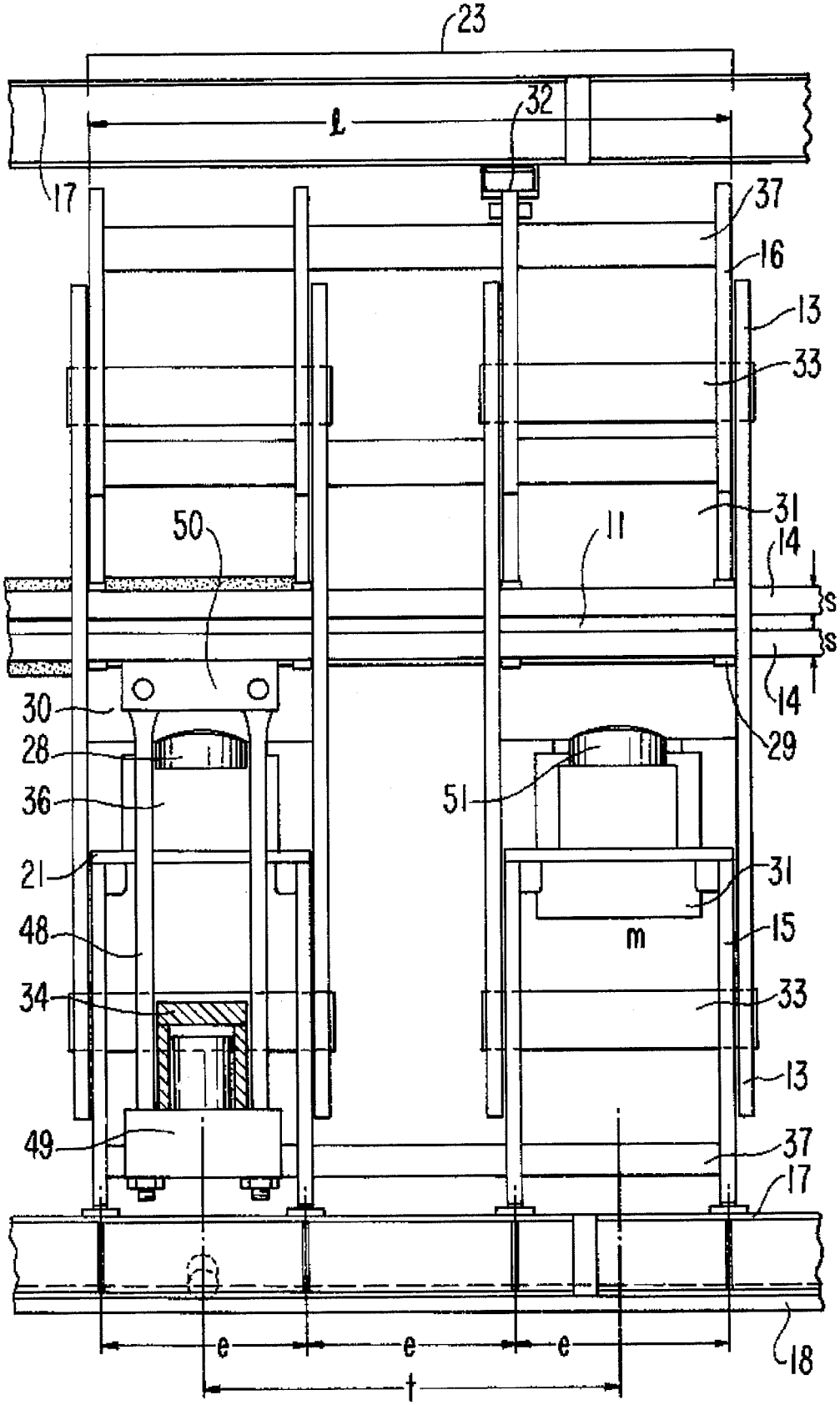
FIG. 3 shows a part C of FIG. 1.

According to FIGS. 1 to 3, the main parts of the continuously operating press according to the invention are the upper and lower press beams 3 and 2 and the tiebars 13, which connect them positively. The tiebars can be released rapidly by means of the push-in pins 33. Side plates 38 are attached to the ends of the press beams 2 and 3 and serve for the anchorage and support in bearings of the driving drums 24, the reversing drums 25 and the entry systems for the rolling rods 12. The press beams 2 and 3 consist of web plates 15 and 16 and ribs 31 connecting them. Four web plates 15 and 16 in each case are connected by means of ties 37 to form each individual beam 23 and, having been arranged in line and having had the press/heating platens 14 mounted on them, these form the length L of the press beams 2 and 3.

FIG. 1 further shows how the reversing drums 25 form the entry gap and how the rolling rods 12 guided around the press beams 2 and 3 with the steel belts 5 and 6 are supported against the press/heating platens 14. This means that the circulating rolling rods 12, as an example of a rolling support, are arranged so as to roll between the press/heating platens 14 and the steel belts 5 and 6. The pressing stock 4 is drawn through the press nip 11 by the steel belts 5 and 6—driven by the driving drums 24—and compressed into boards.

The hydraulic cylinder-piston arrangements 7, 8 and 9 are preferably arranged with the pressure pistons 28 underneath the press/heating platen 14 and are supported on supporting plates 21 of the lower press beam 2. They could just as well be used as top pistons under the upper press beam 3. However, for thermal reasons the bottom-piston arrangement is preferred so as to minimize heating of the hydraulic oil by the rising heat. In order to permit spherical deformation in the transverse direction, for example convex deformation, a higher force takes effect in the case of the central cylinders 36' than in the case of the lateral cylinders 36. This means that a different i.e. higher, hydraulic pressure is set than at the outer cylinders 36. In the case of the preferred convex setting, the central cylinder can alternatively be provided with a larger piston area. The cylinders 36 and 36' and the pressure pistons 28 are each assigned supporting crossmembers 30 and these transmit the centrally acting hydraulic forces from the pressure pistons 28 to the supporting crossmembers 30 and, via supporting bodies 29, to the lower press/heating platen 14. These supporting bodies 29, which are simultaneously designed as highly thermally insulated supporting bodies 29 (thermal insulation components) resistant to high pressure, are arranged at the four corners of the supporting crossmembers 30 in such a way that the support spacings x of the supporting bodies 29 correspond to the support spacings e of the web plates 15 and 16. Here four supporting bodies 29 can take effect per support spacing e (=frame spacing) and supporting crossmember 30. The pretensioning forces on the steel belts 5 and 6 between the entry and exit drum systems are taken as a compressive force by four I-section girders, the lower press beam 2 resting on the lower I-section girder 17, which is anchored in the foundation 18. The web-plate structure of press beam 3 can be suspended on the upper I-section girder 17.by means of screwed joints 32. To achieve the increased pressing-force profile in the front, high-pressure region HP, the cylinders 36 with a greater force, that is a larger cylinder diameter are used, while cylinders 36 with a lower force and a smaller cylinder area are used in the medium-pressure region MP and low-pressure region LP (see FIG. 9), thus matching the pressing-force profile. To allow the servohydraulics to be used to control the position longitudinally in relation to the pressing zone between the upper and lower press/heating platens 14, the return plunger arrangements 34 shown are necessary.

The hydraulic cylinder-piston arrangements are referred to below simply as actuators, 7, 8 and 9. They comprise the cylinder 36, the pressure pistons 28 and, according to a parallel application, supporting cross-members 30 arranged on the pressure pistons and each having four supporting bodies 29. Each row m of actuators is fitted with a position sensor system in accordance with FIGS. 4 and 6 or FIG. 7. Depending on the width of the press, at least three and, in the case of greater widths, four or more actuators are used to change the geometrical position of the press/heating platens 14 (convex, concave, planar). According to FIG. 5, the intention is to set a spherical deformation of the press/heating platen 14, represented by hatching, by means of these hydraulic actuators 7, 8 and 9, the local situation in the region of the pressing zone being shown in perspective. That is, if the press/heating platen 14 is to be set to give an equal vertical deformation of $\Delta yL$ on the left and right along the pressing zone, then, for uniform distribution of the pressing force transversely to the pressing zone, this requires a uniform change in all the hydraulic actuators 7, 8 and 9 arranged transversely to the pressing zone. If, in addition to the change in the displacement position, a convex deformation in the range of a vertical convex setting of $\Delta yL$ is to be set in accordance with $\Delta yQ$ transverse, this requires an increase in the force in the center of the platen, transversely to the pressing zone. This means, in the case of the provision of three actuators 7, 8 and 9, that the centrally arranged actuator 8 must have its force increased or, in the case of four hydraulic actuators, the two centrally arranged actuators must have their force increased. If there is to be no change in the displacement position along ΔyL, this can only be achieved by the principle of net-value control. That is to say, if the central force on the central actuator 8 is increased by the force value x, then the force for the actuators 7 and 9 at the edges must simultaneously be reduced by half. If the procedure described above is to take place at maximum pressing force, this can be achieved by two alternative methods: if, taking FIG. 8 as an example, all three cylinders 36 transversely to the pressing zone have the same cylinder area then, provided the same hydraulic pressure is acting, a congruent bending line as between the upper and lower press/heating platens 14 is established. In order in addition to be able to set an extreme geometrical position for a concave action on the pressing stock 4, the increased force value when using the maximum pressing force is about 30% for the central actuators 8.

Figure 9:
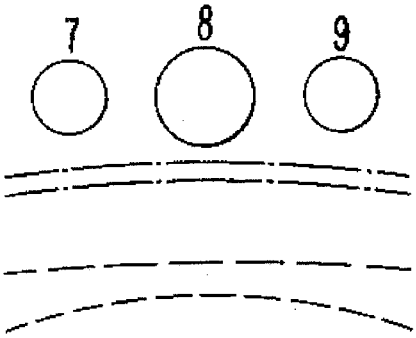

According to FIG. 9, if only the central cylinder 36' (in the case of more than three actuators the central cylinders 36') is increased in area (provides a cost advantage), then, in the case of a congruent bending line, the pressure must be lowered in accordance with the ratio of the areas.

Figure 8:
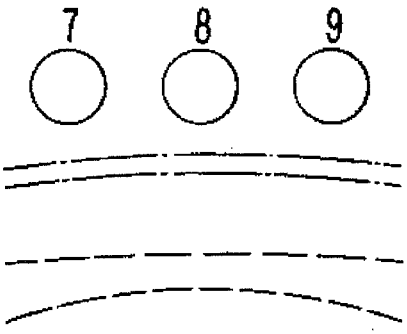
FIG. 8 shows the arrangement of the cylinder dimensioning of the actuators in schematic representation and FIG. 9 like FIG. 8 shows the arrangement of the cylinder dimensioning of the actuators in schematic representation.

Only by means of the structural measures described is it possible to carry out a spherical deformation of a convex nature transversely to the pressing zone—with the press nip 11 being smaller in the center than at the outside—at maximum pressing force. In all cases, the force to be installed in accordance with FIGS. 8 and 9 is greater than 100%, the figure which would be required for the maximum pressing force. In general, it will be in a range of between 105% and 150%, depending on the thickness of the press/heating platen 14 since the inherent stiffness of the press/heating platen 14 in the case of bending deformation, i.e. a concave action on the pressing stock 4 (transversely to the pressing zone), has to be taken into account.

Figure 4:
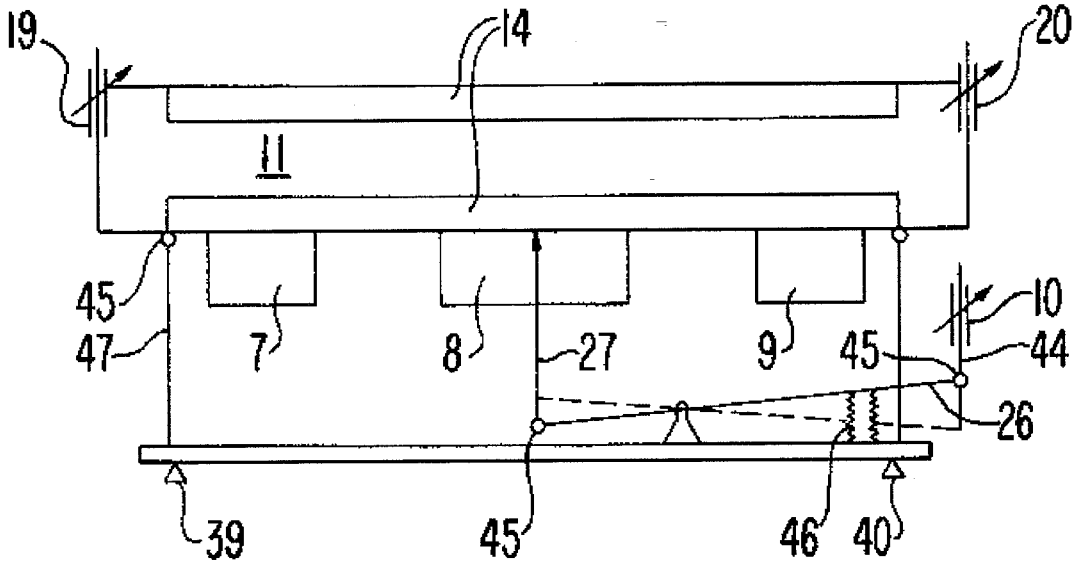
FIG. 4 shows the position-measuring system according to the invention in schematic representation.
Figure 5:
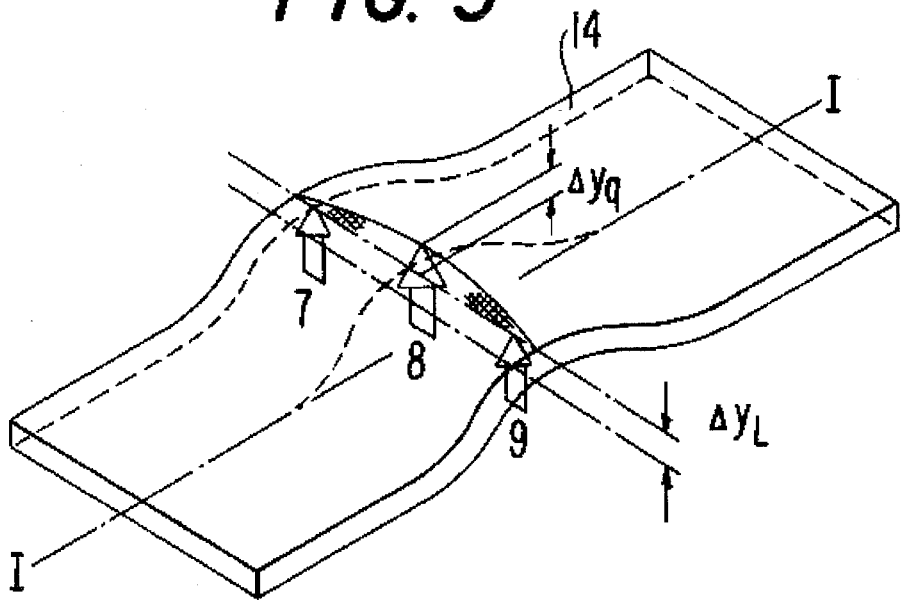
FIG. 5 shows a schematic representation of the press/heating platen with spherical deformation.
Figure 6:
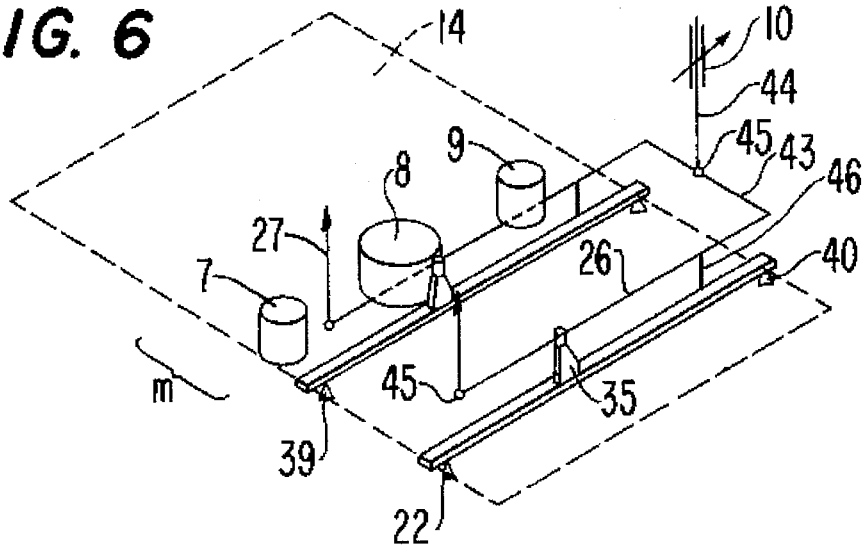
FIG. 6 shows the arrangement of the gauge bar with the lever linkage shown in FIG. 4.
Figure 7:
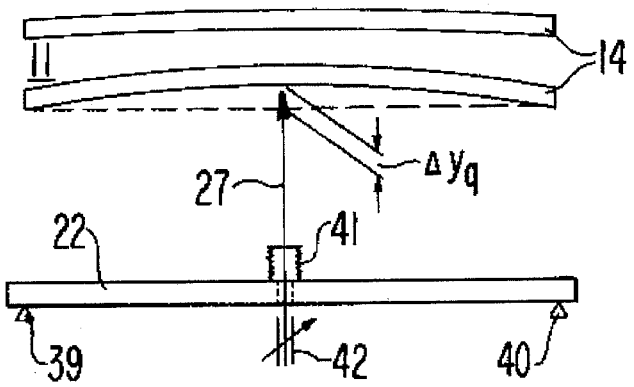
FIG. 7 shows a second embodiment for taking measurements from the press/heating platen.

In order to avoid the time-consuming experimental optimization of the individual hydraulic actuators 7, 8 and 9 according to the prior art, the spherical deformation in the longitudinal and transverse directions in each row m of actuators in accordance with FIGS. 4, 6 or 7 is detected by means of position sensors. As a matter of fundamental principle, all the position sensors 10, 19 and 20 are arranged outside the area in which they would be subject to critical temperature influences. According to FIG. 4 and FIG. 6, the press-nip setting 11 by means of the outer actuators 7 and 9 is recorded by means of lateral position sensors 19 and 20 as an absolute value, in analog or digital form, as the change in the upper and lower press/heating platens 14 relative to one another over the pressing zone. The press-nip actual value is fed into a control and regulating circuit via the position-sensor system with a transmission ratio which enlarges the measured value by from 1:2 to 1:4. A reference gauge bar 22 is suspended underneath the position-sensor systems, on the left and right of the press/heating platen 14 and vertically below these measuring locations. On this mechanical reference gauge bar 22, which is suspended by means of hinges 45 outside the area subject to critical temperature effects, is a fulcrum 35 for the acceptance of a lever arm 26. This is arranged with a feeler rod 27 centrally underneath the lower press/heating platen 14. This feeler rod 27 is pressed into non-positive engagement by dead weight or with the assistance of spring force 46 with the bottom edge of the press/heating platen 14, via hinges 45. The position-measuring system shown in FIGS. 4 and 6 is in each case arranged with two reference gauge bars 22 at two support or suspension points 39 and 40 either side of the rows m of actuators, the reference gauge bars 22 being connected to the press/heating platen 14 at the edges by means of hinges 45, in each case on a hangar 47. Two feeler rods 27, each of which acts on a lever arm 26 via a hinge 45, are likewise connected in a hinged manner, via a connecting rod 43 to the measured-value transmitter 44 which influences the position sensor 10 outside the pressing zone.

The concave or convex deformation of the lower press/heating platen 14, in a range of from 0 to about +3 mm, is transmitted in a ratio of from 1:2 to 1:4—due to the leverage—to the position-measuring system, which is again arranged outside the press. This system is again arranged completely outside any area which might be subject to critical temperature effects, outside the continuous press I and where it is easily accessible at the side. The leverage gives very good metrological resolution.

A simplified measuring system is shown in FIG. 7. Here, the feeler rod 27 is supported on the reference gauge bar 22 by means of a spring 41 and is pressed against the lower edge of the press/heating platen 14. To allow the position sensor 42 to be influenced by the measured-value transmitter 44, the feeler rod 27 is passed through a hole in the reference gauge bar According to FIGS. 2 and 3, the resetting cylinders 34 are of the plunger type with a pull-back linkage, the resetting pistons 52 acting on a crossmember 49 to which two tiebars 48 are connected. The tiebars 48 are connected in a hinged manner to this plate 50 which is in turn attached to the rim of the bottom edge of the lower press/heating platen 14. To allow the supporting crossmembers 30 to adapt freely to the spherical deformation of the press/heating platen 14 in the longitudinal and transverse directions, its supporting surfaces 51 and those of the pressure pistons 28 are advantageously of spherical design, i.e. the pressure pistons 28 and the supporting crossmembers 30 are connected to one another in the manner of a ball-and-socket joint. To increase the ability of the spherical supporting surfaces 51 to slide relative to one another, the pressure pistons 28 and the supporting crossmembers 30 are expediently composed of grey cast iron with a high graphite content (chill casting), the supporting surfaces 51 being surface-hardened to reduce wear.

In the practical application of continuously operating presses, different pressing-stock/board widths will generally be used or produced, depending on orders. The minimum board widths are about 20% to 30% less than the maximum widths. With uniform introduction of force (transversely) into the actuators 7, 8 and 9, there is a tendency for concave deformation of the press/heating platen 14. In known continuously operating presses, planarity at the exit of the press, for example, for the purpose of calibration is established by means of counter heating. As described in the introduction, such a measure acts very slowly. In another known continuously operating press, the concave effect is counteracted by deactivating areas in the outer actuators of the carpet of bottom pistons. Even by this means, exact establishment of plane parallelism by control is only possible to a limited extent for reasons connected with the system. According to the invention, only the outer actuators 7 and 9 are reduced in force in the row m of actuators. As a result, the planarity is geometrically exactly adjusted, as described above, by the position-measuring system integrated in to each row m of actuators. According to the invention, it is possible by means of a closed control circuit between the row of actuators and the position-measuring system to established a geometrically equal press-nip clearance in the transverse direction, even in the case of widely differing press-stock and board widths, for example, smaller than maximum width.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A measuring and control system for a continuously operating press for the production of particle boards, fiber boards and similar wood boards and plastic boards, comprising:

a plurality of flexible endless steel belts;

a plurality of driving drums and reversing drums;

an upper press beam and a lower press beam;

a press/heating platen including an upper press/heating platen and a lower press/heating platen;

a plurality of rolling supporting elements having respective longitudinal axes;

a plurality of cylinder-piston arrangements, that is, actuators, including a plurality of respective cylinders;

wherein the flexible endless steel belts transmit a pressing pressure, pull stock to be pressed through the press, are guided over driving drums and reversing drums around the upper and lower press beams and are supported with an adjustable press nip against the upper and lower press/heating platens on the press beams via the rolling supporting elements which accompany their revolution and are guided with their longitudinal axes transverse to a running direction of the belts, at least one of the lower and the upper press/heating platens being vertically adjustable to set the press nip by the actuators arranged in rows transversely to a longitudinal axis of the press, the force exerted by the actuators being variable in a manner controllable by a position-measuring system for determining the press-nip actual values to control a deformation of the press/heating platens, a) wherein a spherical geometrical deformation of the press/heating platen in the longitudinal and transverse directions is set during start-up or production independently of reaction forces of the pressing stock by different actuating forces in the cylinders of the actuators, the actuators being arranged in positive and non-positive engagement with the press/heating platen, b) wherein, to allow a convex bending deformation of the press/heating platen to be set at the maximum exertable pressing force, central actuators of a row of actuators are respectively dimensioned to give 105% to about 150% of the maximum pressing force in relation to outer actuators, and c) for sensing a press-nip actual value in the center of a row of actuators of the press/heating platen, wherein a position-sensor system comprising a feeler rod, a reference gauge bar, a lever mechanism and a measured-value transmitter with a position sensor is provided, which position-sensor system is arranged outside an area in which the heat might exert a critical influence, underneath the actuators between two web plates, a vertical position of the feeder rod producing the press-nip actual value in the position sensor.

2. The measuring and control system for a continuously operating press as claimed in claim 1, wherein the press-nip actual value is measured via the position-sensor system with a transmission ratio which enlarges the measured value by from 1:2 to 1:4.

3. The measuring and control system for a continuously operating press as claimed in claim 2, wherein the position-sensor system further comprises at least one of two support points and two suspension points for the reference gauge bar, which points are arranged approximately vertically underneath the outer edges of the press/heating platens.

4. The measuring and control system for a continuously operating press as claimed in claim 2, wherein to measure a geometrical position change in the center of the press/heating platen a fulcrum is arranged on the reference gauge bar at a point to the outside of the longitudinal axis of the press in order to accept a lever arm for the transmission of the measured value outside a pressing zone with a transmission ratio of 1:2 to 1:4.

5. The measuring and control system for continuously operating press as claimed in claim 2, wherein outer actuators of a row of actuators include plunger-type resetting cylinders.

6. The measuring and control system for a continuously operating press as claimed in claim 5, wherein the resetting cylinders are designed as plungers with a pull-back linkage, with the lower press beam and the lower press/heating platen connected positively.

7. The measuring and control system for a continuously operating press as claimed in claim 1, wherein the position-sensor system further comprises at least one of two support points and two suspension points for the reference gauge bar, which points are arranged approximately vertically underneath the outer edges of the press/heating platens.

8. The measuring and control system for a continuously operating press as claimed in claim 7, wherein to measure the geometrical position change in the center of the press/heating platen a fulcrum is arranged on the reference gauge bar at a point to the outside of the longitudinal axis of the press in order to accept a lever arm for the transmission of the measured value outside a pressing zone with a transmission ratio of 1:2 to 1:4.

9. The measuring and control system for a continuously operating press as claimed in claim 7, wherein outer actuators of a row of actuators include plunger-type resetting cylinders.

10. The measuring and control system for a continuously operating press as claimed in claim 9, wherein the resetting cylinders are designed as plungers with a pull-back linkage, with the lower press beam and the lower press/heating platen connected positively.

11. The measuring and control system for a continuously operating press as claimed in claim 1, wherein to measure a geometrical position change in the center of the press/heating platen a fulcrum is arranged on the reference gauge bar at a point to the outside of the longitudinal axis of the press in order to accept a lever arm for the transmission of the measured value outside the pressing zone with a transmission ratio of 1:2 to 1:4.

12. The measuring and control system for a continuously operating press as claimed in claim 11, wherein outer actuators of a row of actuators include plunger-type resetting cylinders.

13. The measuring and control system for a continuously operating press as claimed in claim 12, wherein the resetting cylinders are designed as plungers with a pull-back linkage, with the lower press beam and the lower press/heating platen connected positively.

14. The measuring and control system for a continuously operating press as claimed in claim 1, wherein a plurality of resetting cylinders are arranged at outer edges of the press/heating platen on each longitudinal side.

15. The measuring and control system for a continuously operating press as claimed in claim 14, wherein the resetting cylinders are designed as plungers with a pull-back linkage, with the lower press beam and the lower press/heating platen connected positively.

16. The measuring and control system for a continuously operating press as claimed in claim wherein the resetting cylinders are designed as plungers with a pull-back linkage, with the lower press beam and the lower press/heating platen connected positively.

17. The measuring and control system for a continuously operating press as claimed in claim 1, wherein the actuators include pressure pistons and supporting crossmembers, each having respective supporting surfaces, and wherein the supporting surfaces of the pressure pistons and of the supporting crossmembers are spherical in relation to one another.

18. The measuring and control system for a continuously operating press as claimed in claim 1, wherein the actuators include at least one of supporting crossmembers and pressure pistons which are composed of grey cast iron and have surface-hardened spherical supporting surfaces.

19. The measuring and control system for a continuously operating press as claimed in claim 1, wherein, with the position-measuring system, a geometrically equal press-nip clearance is established in the transverse direction, even in the case of widely differing pressing-stock and board widths, for example smaller than maximum width.

* * * * *